US005725398A

United States Patent [19]

Cappe

[11] Patent Number: 5,725,398

[45] Date of Patent: Mar. 10, 1998

[54] ELECTRICAL CONNECTOR INCORPORATING CONTACT-LOCKING GRID

[75] Inventor: Patrice Cappe, Faverolles, France

[73] Assignee: Framatome Connectors International, Courbevoie, France

[21] Appl. No.: 600,211

[22] Filed: Feb. 12, 1996

[30] Foreign Application Priority Data

Feb. 10, 1995 [FR] France ..... 95 01577

[51] Int. Cl.[6] ..... H01R 13/514

[52] U.S. Cl. ..... 439/752

[58] Field of Search ..... 439/752, 595, 439/352, 852

[56] References Cited

U.S. PATENT DOCUMENTS 5,199,902 4/1993 Kahle et al. ..... 439/752

FOREIGN PATENT DOCUMENTS 2424643 11/1979 France .
2702889 9/1994 France .

*Primary Examiner*—Khiem Nguyen
*Assistant Examiner*—Eugene G. Byrd
*Attorney, Agent, or Firm*—Pollock, Vande Sande & Priddy

[57] ABSTRACT

The electrical connector comprises a plug (12) incorporating a housing (22) and a contact-locking grid (32) designed to be inserted in the plug housing until a contact-locking position is reached, and a mounting base (10) incorporating a housing which delimits a cavity for insertion of the contact-locking grid and a drawer (14) which is inserted by force. The grid belonging to the base comprises at least one tab (60) designed to constitute a stop blocking the plug prior to engagement of the pegs in the slots in the drawer (14) when the grid in not fully inserted. This tab (60) is connected to the body of the grid by a thin part forming a hinge, which moves the plate out of the path of a plug component when the grid (32) is fully inserted.

4 Claims, 2 Drawing Sheets

FIG. 5A
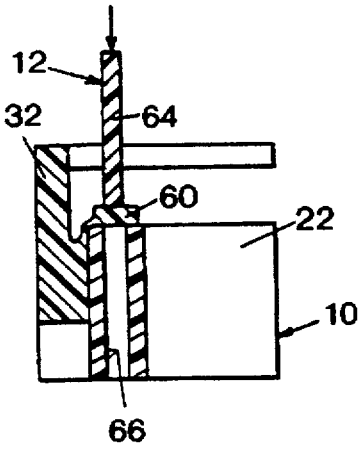
FIG. 5B
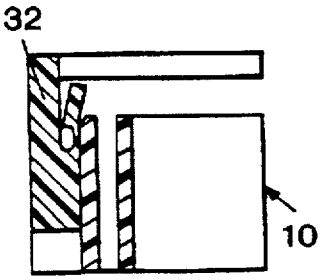
FIG. 5C
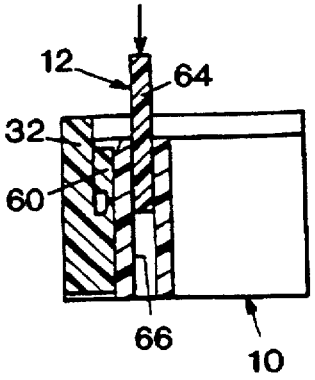
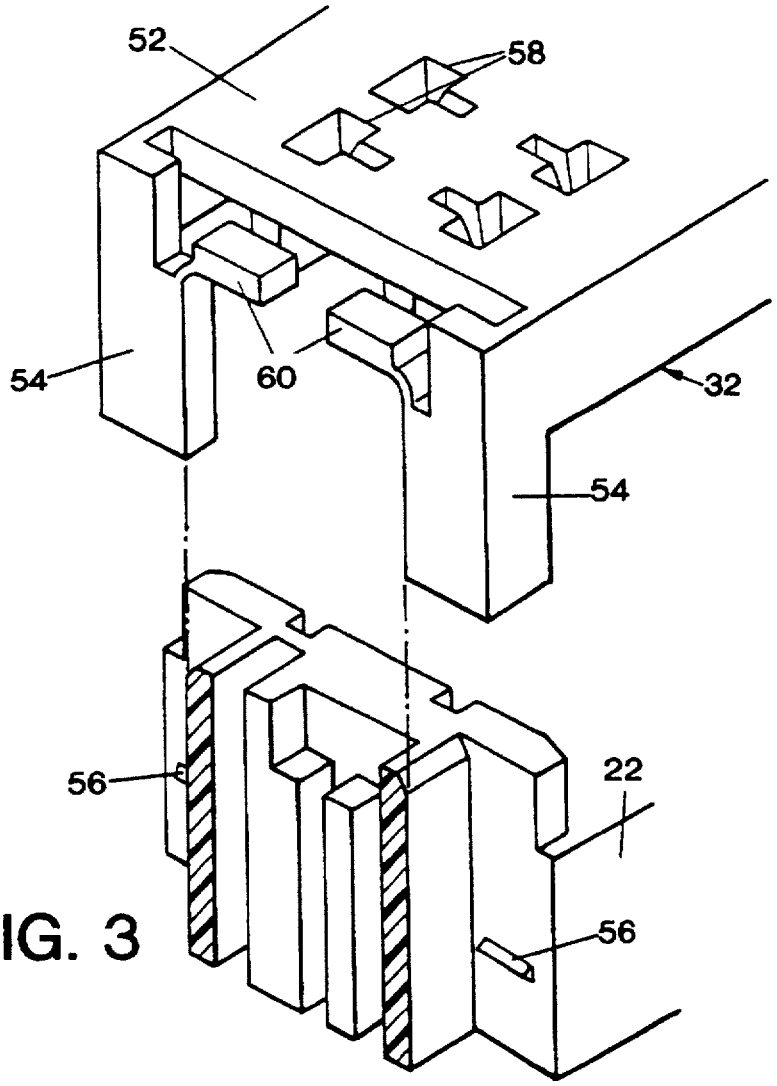
FIG. 3

ELECTRICAL CONNECTOR INCORPORATING CONTACT-LOCKING GRID

BACKGROUND OF THE INVENTION

The present invention concerns a rectangular electrical connector of the so-called "assisted insertion and removal" type, comprising a plug, a mounting base, and a forced plug-insertion and removal drawer. The current state of the art includes numerous connectors of this type, for example, that described in Patent No. FR-A-2 424 643.

More specifically, the invention concerns connectors whose bases are equipped with a grid designed to lock the contacts belonging to the base in position when the grid is fully inserted on the base. This grid is often provided to permit a pre-locking position, in which the grid remains fastened to the base housing, while, however, allowing the positioning or removal of the contacts. It is important not to plug in the connector for as long as the grid does not lock the contacts in place, because the grid is not fully inserted. In fact, the contacts are, in that configuration, held in place elastically only. The grid may remain incompletely inserted either because of an omission in the pre-locking position, or because its travel has been halted by a poorly-placed contact.

In particular, the invention is intended to remove the risk of connecting the plug and the mounting base while the grid incorporated into the base is not in its fully-inserted position.

SUMMARY OF THE INVENTION

To this end, the invention proposes an electrical connector comprising:

a plug having a rectangular housing incorporating slots parallel to one direction of insertion and designed to receive the first electrical contacts;

a base having a housing incorporating slots, parallel to the direction of insertion, for receiving second electrical contacts, this base delimiting a cavity designed to house a grid for locking the second contacts and to be inserted in the plug housing in a direction opposite the direction of insertion until reaching a contact-locking position in the plug base, and a drawer movable in the mounting base transversely to the direction of insertion and having slides incorporating slots comprising oblique portions for the forced travel of pegs belonging to the plug housing, so that movement of the drawer in one direction causes the insertion of the plug in the cavity, and movement, in the other direction, removal of the plug;

The grid is provided with at least one tab designed to form a stop-motion device which stops the plug before engagement of the pegs in the slots when the grid is not fully inserted, this tab being connected to the grid body by a thin hinge-forming element, which is designed to bend and move the tab away from the path of a plug element during complete insertion of the grid.

To facilitate engagement of the pegs in the slots, the latter advantageously comprise an entry zone parallel to the direction of insertion. Beyond the oblique, ramp-shaped portion, the slots may comprise an end part substantially parallel to the direction of motion of the drawer, and thus perpendicular to the direction of insertion, thereby preventing vibrations from tending to detach the plug from the base while forcing out the drawer.

BRIEF DESCRIPTION OF THE DRAWINGS

Still other features of the invention will emerge from a reading of the following description of an embodiment provided by way of example. The description makes reference to the accompanying drawings, in which:

FIG. 3 is a perspective view illustrating a portion of the grid and a portion of the base housing, prior to the positioning of the grid;

FIGS. 5*a*, 5*b*, and 5*c* are skeleton diagrams showing the successive positions of the stop-motion plates belonging to the grid at various stages of insertion thereof.

DETAILED DESCRIPTION

Figure 1:
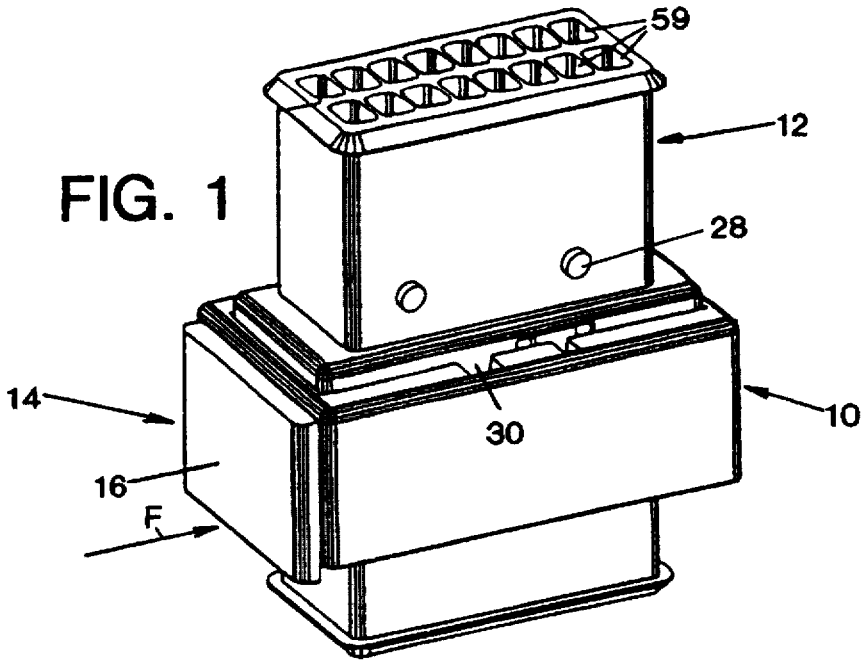
FIG. 1 is a perspective view of the coupled connector, the drawer being inserted and the grid belonging to the base being in the locking position.

The connector illustrated in FIG. 1 comprises a mounting base 10 and a plug 12. The terms "plug" and "base" are used for purposes of convenience and are not meant to imply that the base constitutes the stationary component of the connector. The mounting base carries a clamp-shaped insertion and removal drawer 14 having an end piece 16 and two sides 17.

The base 10 is often designed to receive the contacts constituted by cage-shaped female contact terminals, while the plug 12 is designed to receive tongue-shaped contacts. This arrangement is, however, not a limiting one.

The base 10 comprises a housing having an elongated rectangular section. Two slots are cut in at least one of the short sides. They allow insertion of the sides 17 of the drawer 14, which slides against the internal surfaces of the long sides and is guided by a internal edge incorporated into the long sides. Accordingly, the drawer 14 can move in the direction F, but is held in the direction of insertion and removal, which is orthogonal to F. The base housing comprises slots for receiving electrical contacts which, in the embodiment illustrated, are arranged in two rows. The housing is cut out so as to form elastic fingers 100 designed to hold the contacts in their proper positions.

In addition to the housing 22, the mounting base comprises a contact-locking grid 32. When completely inserted, this grid prevents the fingers from bending elastically and releasing the contacts. A grid performing this function is described, for example, in U.S. Pat. No. 5,299,949, to which reference may be made. It comprises a median extension which is inserted between the elastic fingers belonging to the two rows.

Figure 2:
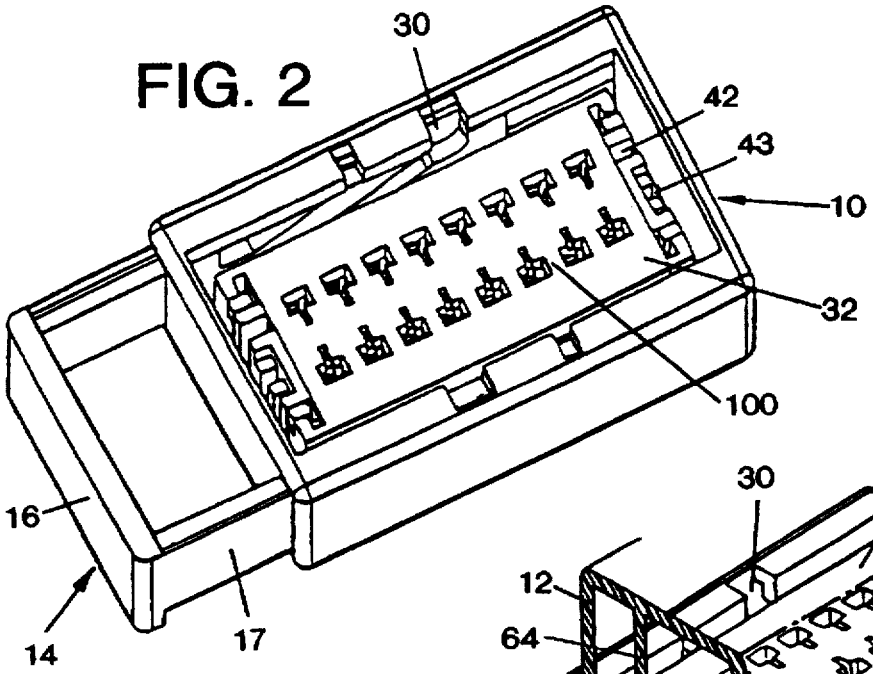
FIG. 2 is a perspective view of the base, the grid being in the locking position, and the drawer, in the stand-by position.
Figure 4:
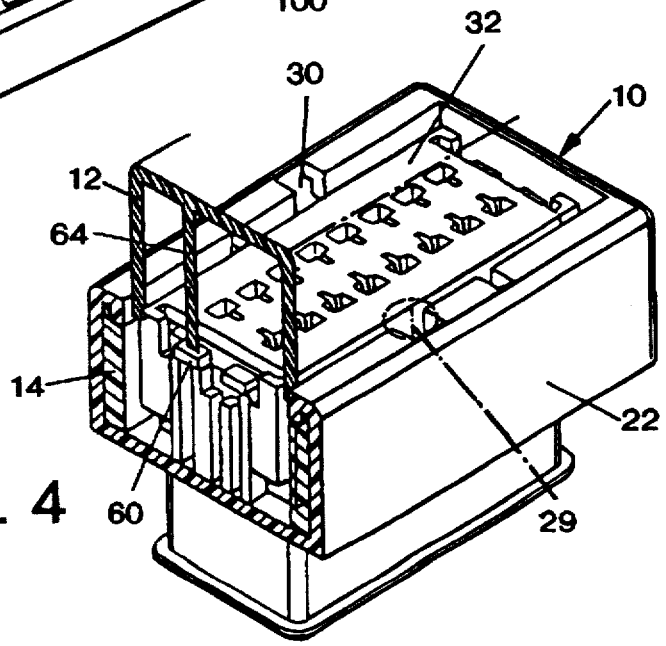
FIG. 4 is a skeleton diagram showing the plug stopped against the grid when the latter is not fully inserted.

The grid 32 may be configured as illustrated in part in FIGS. 2, 3, and 4. It is a one-piece grid and comprises a support plate 52 against the bottom of the housing and feet 54 designed to be inserted in slots provided in the angles of the housing 22. Catches 56 are normally provided on the housing for insertion in notches in the feet 54 and to hold the grid 32 elastically either in a locking position, or in a pre-locking position in which it is held in place on the housing, but without preventing replacement of the contacts. The plate 52 comprises openings 58 for the contacts and aligned with the slots in of the housing 22.

The plug 12 also comprises a housing having a rectangular section. Most of the external surface thereof is smooth. Its front part is configured to permit insertion in a cavity in the base by sliding against the short sides and against the internal edges of the base housing, which guide the drawer.

Contact-insertion slots aligned with those in the base and elastic fingers designed to hold these contacts in place are provided in the housing of the plug 12. A grid is generally incorporated into the plug, in order to lock in place the contacts belonging to the plug. This grid (not shown) may have the structure described in U.S. Pat. application Ser. No. 08/600,209 filed the same day as the present application and concerning an "Electrical Connector Incorporating A Contact-Locking Grid and Drawer."

The drawer 14 and the plug 12 comprise cooperating means designed to bring about, in response to the travel of the drawer 14 in the direction of the arrow F, the insertion and locking of the plug, and to cause the removal of the plug by moving the drawer in the opposite direction. These means, which are borne by the plug and the drawer 14, comprise pegs 28 projecting outward from the long sides of the plug housing and designed to be inserted in slots 29,30 cut in the sides of the drawer 14. These slots have an oblique portion constituting a cam ramp.

To prevent the plug from being connected in a reversed position, so-called "polarization" means are normally provided. In the embodiment shown in FIG. 2, they comprise one or two internal ribs 64 incorporated into the plug housing and designed to be inserted in slots 42 in the base housing 22. They may be supplemented by coding ribs which are inserted in other slots 43 in the housing 22.

The grid 32 is designed not only to lock the contacts in place, but also to prevent the entry of the plug when it is only partially inserted. To this end, the grid 32 comprises two hinged tabs 60 (this number not being restrictive connected to respective feet 54 by parts of the grid that are thinner than the rest thereof and which are designed to form flexible hinges. The grid is molded simultaneously with the tabs 60 in the position in which they are illustrated in FIG. 3, that is, extending parallel to the plate 52. In this way, they tend elastically to adopt the position shown in FIGS. 3, 4, and 5A, in which they are located in the path of one or several tongues 64 belonging to the plug housing. In the embodiment shown in FIG. 4, a single tongue is provided. Depending on the position of the grid 32 this tongue is stopped against one or the other of tabs 60. The slots in the housing designed to receive the feet 54 gradually depress the tabs 60 as the grid 32 is pushed in, as illustrated in FIGS. 5B and 5C, so that, finally, the pathway of the tongue 64 is cleared so that it can be pushed into a slot 66 in the housing, thereby completing the completed connection.

The catches 56 are advantageously placed so that the pre-locking position of the grid 32 is that illustrated in FIG. 5A. In this case, attempts to insert the plug are blocked, since the tongue 64 comes to rest against the tab 60, which is prevented from bending because it is supported on the edges of the slot 66. Once past the pre-locking position, the grid 32 takes on, for example, the position shown in FIG. 5B, i.e., it begins to free the pathway of the tongue 64. The latter may then be inserted in the slot 66, potentially by drawing the grid into its full locking position.

The invention extends to numerous variants. Tabs 60 may be placed on each side of the grid 32. Tongues may be provided on each side of the plug, and not on one side only. In any event, the connector components are of sufficiently simple form so that they can be manufactured from plastic in molds having a small number of moving parts.

What is claimed is:

1. An electrical connector comprising:

(a) a plug having a plug housing comprising slots parallel to a direction of insertion and adapted to receive first electrical contacts, and a contact-locking grid adapted to be inserted in said plug housing in a direction opposite to said direction of insertion until a contact-locking position is reached;

(b) a mounting base having a rectangular housing comprising slots for insertion of second electrical contacts and parallel to the direction of insertion, said mounting base delimiting a cavity for housing a grid which locks said second electrical contacts in place in said plug housing in a direction opposite said direction of insertion, until a contact-locking position in said mounting base is reached;

(c) a drawer movable in said mounting base transversely to said direction of insertion, said drawer having sides incorporating slots comprising an oblique portion for forced travel of pegs of said plug housing, so that the travel of the drawer in one direction causes insertion of said plug in said cavity, and, in an opposite direction, removal of said plug;

(d) wherein said grid comprises at least one tab adapted to form a stop blocking said plug prior to engagement of said pegs in said slots in said drawer when said grid is incompletely inserted, said tab being joined to a body of said grid by a thin part forming a hinge which is adapted to bend and move said tab out of a path of a plug component when said grid is completely inserted.

2. The electrical connector according to claim 1, wherein each tab is connected to a foot belonging to said body of said grid in said mounting base, and said housing of said mounting base comprises slots allowing sliding movement of feet of said grid, thin part is caused to bend when said feet are completely inserted in said housing of said mounting base.

3. The electrical connector according to claim 2, wherein said plug component is a tongue adapted to engage in a slot in said base housing, sides of said slot constituting support elements for a corresponding tab.

4. The electrical connector according to claim 3, wherein said base housing and said grid comprise cooperating means adapted to hold said grid elastically in a pre-locking position in which said tab prevents insertion of said foot in a corresponding slot.

* * * * *